US008775123B2

(12) United States Patent
Bersch et al.

(10) Patent No.: US 8,775,123 B2
(45) Date of Patent: Jul. 8, 2014

(54) METHOD FOR DETERMINATION OF THE COEFFICIENT OF PERFORMANACE OF A REFRIGERATING MACHINE

(75) Inventors: Hans-Jürgen Bersch, Simmerath (DE); Raymond Steils, Embourg (BE)

(73) Assignee: Emerson Climate Technologies GmbH, Waiblingen (DE)

( * ) Notice: Subject to any disclaimer, the term of this patent is extended or adjusted under 35 U.S.C. 154(b) by 339 days.

(21) Appl. No.: 12/635,019

(22) Filed: Dec. 10, 2009

(65) Prior Publication Data

US 2010/0153057 A1 Jun. 17, 2010

(30) Foreign Application Priority Data

Dec. 11, 2008 (DE) ..... 10 2008 061 631

(51) Int. Cl.
*G06F 11/30* (2006.01)
*G21C 17/00* (2006.01)

(52) U.S. Cl.
USPC ..... 702/182

(58) Field of Classification Search
CPC ..... F24F 11/001; F24F 2011/0058; F24F 2011/0071
USPC ..... 702/182
See application file for complete search history.

(56) References Cited

U.S. PATENT DOCUMENTS

| | | | | |
|---|---|---|---|---|
| 4,510,576 | A * | 4/1985 | MacArthur et al. | 702/182 |
| 5,735,134 | A | 4/1998 | Liu et al. | |
| 2003/0019221 | A1* | 1/2003 | Rossi et al. | 62/127 |
| 2005/0132735 | A1* | 6/2005 | Chen et al. | 62/208 |

FOREIGN PATENT DOCUMENTS

| | | | |
|---|---|---|---|
| DE | EP20080001376 | * | 7/2008 |
| EP | 0100210 | A2 | 2/1984 |
| EP | 1914481 | A2 | 4/2008 |
| EP | 1 950 511 | A1 | 7/2008 |
| JP | 2004-176938 | A | 6/2004 |
| JP | 20040176938 | A | 6/2004 |
| JP | 2007278618 | A | 10/2007 |

OTHER PUBLICATIONS

Supplementary Search Report in corresponding European Patent Application No. 09014744.8 dated Aug. 13, 2010 and English language translation of the search report.

(Continued)

*Primary Examiner* — John Breene
*Assistant Examiner* — Manuel Rivera Vargas
(74) *Attorney, Agent, or Firm* — The Webb Law Firm

(57) ABSTRACT

The present invention relates to a method for the determination of the coefficient of performance of a refrigeration machine, in particular of a heat pump, which includes a closed circuit which has a refrigerant and in which an evaporator, a compressor, a condenser and an expansion valve are arranged. In the method, at least three temperatures of the refrigerant are determined using temperature sensors arranged in the circuit. Alternatively, at least two temperatures and at least one pressure of the refrigerant is determined using sensors arranged in the circuit. Enthalpies of the circuit are calculated from the determined refrigerant temperatures and refrigerant pressures and the heat output and the taken up electrical power of the refrigeration machine are calculated therefrom to determine the coefficient of performance of the refrigeration machine from the quotient of the calculated heat output and the calculated taken up electrical power. The invention also relates to a refrigeration machine for the carrying out of such a method.

3 Claims, 4 Drawing Sheets

(56) References Cited

OTHER PUBLICATIONS

German Search Report for corresponding German Patent Application No. 10 2008 061 631.1 dated Oct. 16, 2009, 4 pages.

English Translation of German Search Report for corresponding German Patent Application No. 10 2008 061 631.1 dated Oct. 16, 2009, 5 pages.

European Search Report dated May 7, 2010 in corresponding European Patent Application No. 09014744.8-2301, 5 pages.

* cited by examiner

METHOD FOR DETERMINATION OF THE COEFFICIENT OF PERFORMANACE OF A REFRIGERATING MACHINE

CROSS-REFERENCE TO RELATED APPLICATIONS

This application claims priority to co-pending German Patent Application Ser. No. 10 2008 061 631.1, filed Dec. 11, 2008, the entirety of which is incorporated by reference herein.

BACKGROUND OF THE INVENTION

Field of the Invention

The present invention relates to a method for the determination of the coefficient of performance of a refrigeration machine, in particular of a heat pump, which includes a closed circuit which has a refrigerant and in which an evaporator, a compressor, a condenser and an expansion valve are arranged.

The quotient from the heat output of the refrigeration machine and the taken up electrical power of the refrigeration machine is called the coefficient of performance (COP) of a refrigeration machine. Conventionally, the electrical power take-up of the refrigeration machine is detected via an electricity meter, whereas the heat output of the refrigeration machine is determined by a temperature measurement and a volume flow measurement on the water side of the refrigerant circuit, i.e. that is behind the condenser.

A method is also known in which the temperatures and the pressures of the refrigerant are detected using two pressure sensors and three temperature sensors at different points of the circuit and are used for the calculation of the coefficient of performance. The electrical power take-up of the refrigeration machine is also detected by means of an electricity meter. The heat output of the refrigeration machine can then be calculated by multiplying the coefficient of performance by the taken up electrical power.

It proves to be problematic with the known methods or refrigeration machines that both the electricity meter and the pressure sensors represent a not unsubstantial cost factor.

BRIEF DESCRIPTION OF THE INVENTION

In a method in accordance with the invention, at least three temperatures of the refrigerant are determined for the determination of the coefficient of performance of a refrigeration machine, in particular of a heat pump, which includes a closed circuit which has a refrigerant and in which an evaporator, a compressor, a condenser and an expansion valve are arranged, using at least three temperature sensors which are arranged in the circuit. Enthalpies and pressures of the circuit are calculated from the determined refrigerant temperatures and both the heat output and the taken up electrical power of the refrigeration machine are calculated from differences of the calculated enthalpies. The coefficient of performance is finally determined from the quotient of the calculated heat output and the calculated taken up electrical power.

In a method in accordance with the invention, the coefficient of performance of the refrigeration machine is in other words determined only with reference to temperature values which are delivered by three temperature sensors arranged in the refrigerant circuit, with a specific knowledge of the thermodynamic properties of the system, in particular of the refrigerant and of the compressor, being required. A minimum of information on the refrigerant circuit which is required to be able to determine the coefficient of performance of the refrigeration machine is determined by the measurement of the refrigerant temperatures at three different points of the refrigerant circuit.

A use of additional sensors, e.g. of further temperature sensors or pressure sensors, which are typically approximately ten times more expensive than temperature sensors, is thus generally not required. The use of a costly electricity meter can in particular be dispensed with. The use in accordance with the invention of a minimal number of temperature sensors therefore makes it possible to determine the coefficient of performance of a refrigeration machine with a minimal cost effort.

In accordance with an advantageous embodiment of the method, a first temperature is measured in the region of the inlet of the compressor, a second temperature is measured in the region of the outlet of the condenser and a third temperature is measured in the region of the outlet of the expansion valve. The refrigerant temperatures measured at these points of the refrigerant circuit are generally sufficient to determine the enthalpies of the circuit and ultimately to determine the coefficient of performance of the refrigeration machine from them.

Alternatively, a fourth temperature can additionally be determined by means of a fourth temperature sensor and can be used for the determination of the coefficient of performance, with the fourth temperature preferably being determined in the region of the outlet of the compressor. By the measurement of the refrigerant temperature at the compressor outlet, this temperature no longer has to be calculated by a compressor model, but it can rather be determined exactly. The coefficient of performance can be determined more simply, faster and more precisely in this manner.

In the method in accordance with the invention in accordance with claim 4, at least two temperatures and one pressure of the refrigerant are determined for the determination of the coefficient of performance of a refrigeration machine using at least two temperature sensors and at least one pressure sensor which are arranged in the refrigerant circuit. Enthalpies of the circuit are calculated from the determined refrigerant temperatures and the determined refrigerant pressure and the heat output and the taken up electrical power of the refrigeration machine are calculated from differences between the enthalpies. The coefficient of performance of the refrigeration machine is then determined from the quotient of the calculated heat output and the calculated taken up electrical power.

In this variant of the method in accordance with the invention, the coefficient of performance of the refrigeration machine can also be determined using a minimal number of sensors and in particular without an electricity meter and thus particularly cost-effectively. In this case, the determination of the coefficient of performance takes place only with reference to the measured values delivered by the two temperature sensors and by the one pressure sensor, with specific knowledge of the system, in particular of the thermodynamic properties of the refrigerant and of the compressor, also having to be required here.

In accordance with an advantageous embodiment of the method, a first temperature is measured in the region of the inlet of the compressor, a second temperature is measured in the region of the outlet of the condenser and a first pressure is measured in the region of the outlet of the evaporator.

In addition, a third temperature can be determined and can be used for the determination of the coefficient of performance, with the third temperature preferably being determined in the region of the outlet of the compressor. Due to the additional measurement of a third temperature, it is possible to replace calculations which are required on the use of only three sensors for the determination of the enthalpies, in particular for the determination of the coolant temperature at the compressor outlet, by an actual measurement, whereby the determination of the coefficient of performance of the refrigeration machine can take place more simply, faster and with a higher precision.

Alternatively or additionally, a second pressure can be determined and can be used for the determination of the coefficient of performance, with the second pressure preferably being determined in the region of the outlet of the condenser. The measurement of the second pressure also contributes to a faster and more precise determination of the coefficient of performance in that the calculation of the pressure value required without the direct measurement can be dispensed with.

Further subject matters of the invention are moreover the refrigeration machines disclosed herein. The methods in accordance with the invention can be carried out particularly easily and the above advantages can be achieved correspondingly using these refrigeration machines.

BRIEF DESCRIPTION OF THE DRAWINGS

The present invention will be described in the following purely by way of example with reference to advantageous embodiments and to the enclosed drawings. There are shown.

DETAILED DESCRIPTION

Figure 1:
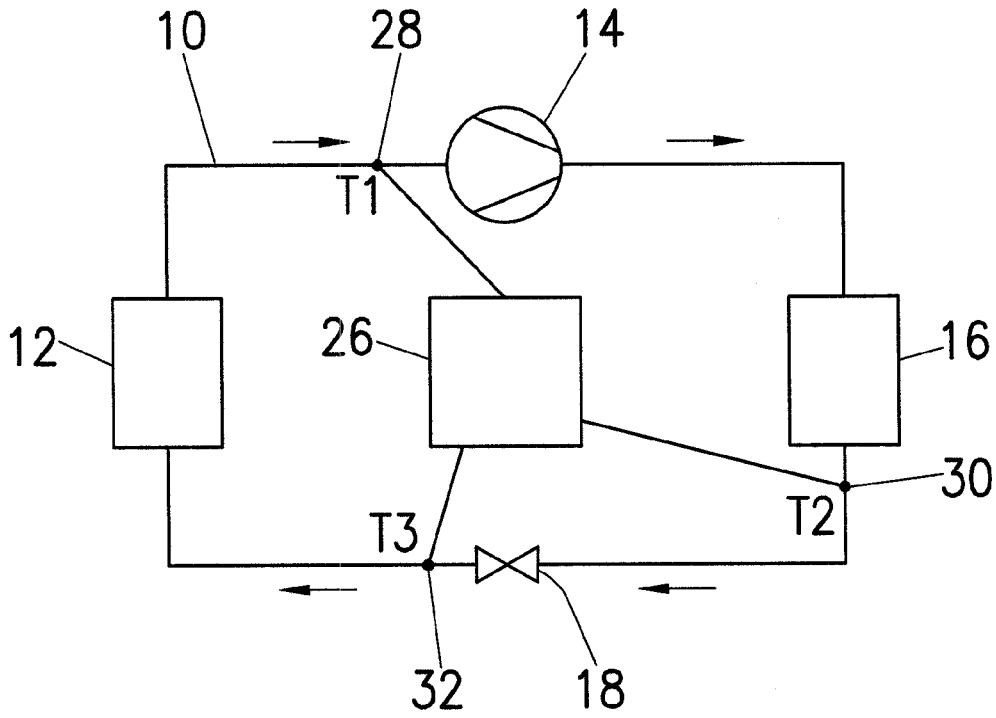
FIG. 1 a schematic representation of a first embodiment of a refrigeration machine in accordance with the invention.

A first embodiment of a refrigeration machine in accordance with the invention is shown in FIG. 1. The refrigeration machine includes a closed circuit 10 which has a refrigerant and in which an evaporator 12, a compressor 14, a condenser 16 and an expansion valve 18 are arranged.

For the determination of the refrigerant temperature, a temperature sensor 28 is arranged in the region of the inlet of the compressor 14, a temperature sensor 30 is arranged in the region of the outlet of the condenser 16 and a temperature sensor 32 is arranged in the region of the outlet of the expansion valve 18. The temperature sensors 28, 30, 32 are connected to an evaluation unit 26 which can be integrated in a control of the refrigeration machine.

Figure 2:
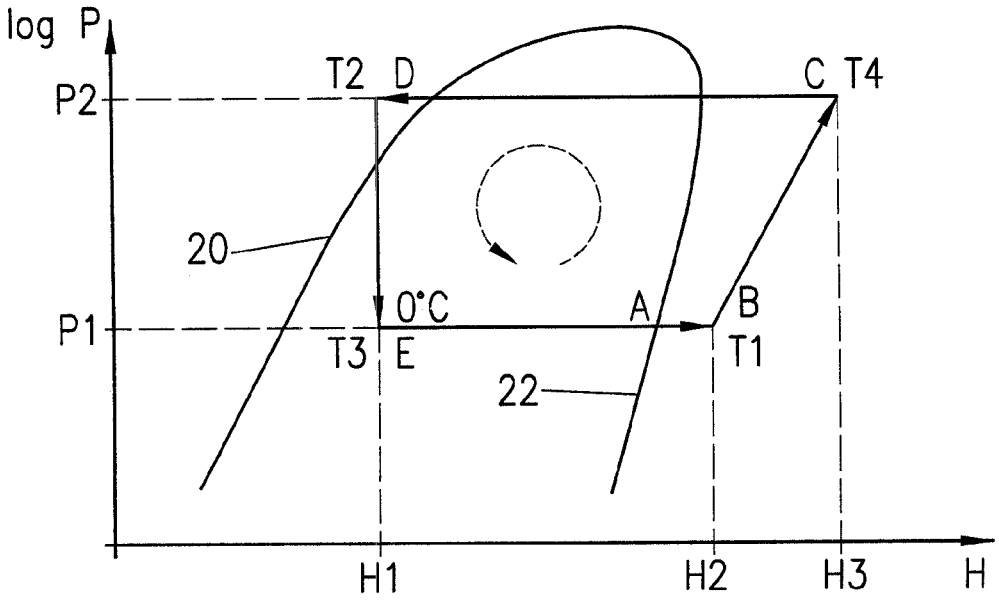
FIG. 2 a log p-h diagram of the refrigerant of the refrigeration machine of FIG. 1 and the associated cycle.

The refrigeration machine is described here in its function as a heat pump. FIG. 2 shows for this purpose a log p-h diagram of the refrigerant used in the refrigeration machine, with the pressure p of the refrigerant being entered logarithmically as the function of the enthalpy H. In addition, the limits of saturated liquid 20 and saturated gas 22 are drawn.

The point E in FIG. 2 designates the state of the refrigerant after the expansion through the expansion valve 18. An evaporation (E-A) and overheating (A-B) of the refrigerant takes place in the evaporator 12.

The compressor 14 provides a compression (B-C) of the refrigerant which is accompanied by a corresponding temperature increase. The temperature of the refrigerant can be increased, for example, from approximately +10° C. at the outlet of the evaporator 12 up to approximately +90° C. by the compressor 14.

A condensing (C-D) of the refrigerant takes place in the condenser 16, with the condensation temperature being able to amount, for example, to +50° C. The now liquid refrigerant which is only 50° C. warm is subsequently expanded by the expansion valve 18 (D-E), with it cooling down to approximately 0° C., for example.

In the following, the temperature of the gaseous refrigerant at the inlet of the compressor 14 is designated as T1; the temperature of the liquid refrigerant at the outlet of the condenser 16 as T2; the temperature of the expanded refrigerant at the outlet of the expansion valve 18 as T3; and the temperature of the gaseous refrigerant at the outlet of the compressor 14 as T4.

The evaporation pressure, i.e. that is the pressure of the gaseous refrigerant at the outlet of the evaporator 12 is designated as P1 and the condensing pressure, i.e. that is the pressure of the liquid refrigerant at the outlet of the condenser 16 as P2.

First the enthalpy H1 is determined at the outlet of the condenser 16, the enthalpy H2 at the inlet of the compressor 14 and the enthalpy H3 at the outlet of the compressor 14 to determine the coefficient of performance of the refrigeration machine.

In this respect, the enthalpy H1 is a function of the refrigerant temperature T2 at the outlet of the condenser, the enthalpy H2 is a function of the refrigerant temperature 11 at the inlet of the compressor 14 and of the refrigerant pressure P1 at the outlet of the evaporator 12; and the enthalpy H3 is a function of the refrigerant temperature T4 at the outlet of the compressor 14 and of the refrigerant pressure P2 at the outlet of the condenser 16:

$$H1=f(T2) \tag{1}$$

$$H2=f(P1,T1) \tag{2}$$

$$H3=f(P2,T4) \tag{3}$$

In the embodiment shown in FIG. 1, the determination of the temperatures T1, T2, T3 takes place by measurement using the temperature sensors 28, 30 and 32 respectively. The temperature values T1, T2, T3 detected by the temperature sensors 28, 30, 32 are communicated to the evaluation unit 26.

Using the pressure equation of the refrigerant used, the evaluation unit 26 calculates the pressure P2 from the received value for the temperature T2 at the outlet of the condenser 16 and the pressure P1 from the temperature value T3 at the outlet of the expansion valve 18. The generally known Clausius-Clapeyron equation can be used, for example, as the pressure equation.

With knowledge of the temperatures T1 and T2 and of the pressure P1, the enthalpies H1 and H2 can now be determined by equations (1) and (2).

The enthalpy H3 is calculated from the compressor model since the temperature T4 is not known.

It is assumed for this purpose that approximately 95% of the electrical power taken up by the compressor 14 is induced into the refrigeration circuit. The electrical power Qe1 taken up by the compressor 14 is in this respect not determined by an electricity meter, but is rather calculated by a model describing the thermodynamic properties of the compressor 14, e.g. a 10-coefficient model.

Not only the electrical power taken up by the compressor 14 can be calculated using this model, but also the refrigerating capacity Q0 of the compressor 14, the electrical current I taken up by the compressor 14 and the mass flow m° of the refrigerant flowing through the compressor 14.

In this respect, the values calculated only apply to the documented operating point of the compressor 14 either at a constant overheating or at a constant suction gas temperature, i.e. at a constant temperature T1 of the refrigerant at the compressor inlet. To calculate the values of the real operating point, the values have to be corrected in dependence on the real compressor inlet temperature T1.

The electrical power Qe1 taken up by the compressor 14 is divided by the mass flow m° to determine the enthalpy difference H3-H2.

$$Qe1/m^{\circ}=H3-H2 \quad (4)$$

Since the enthalpy H2 is known from equation (2), the enthalpy H3 can be calculated easily from the enthalpy difference H3–H2.

For control, the refrigerant temperature T4 at the compressor outlet is calculated from the point of intersection of the line of enthalpy H3 with the line of the pressure P2 in the log p-h diagram of FIG. 2.

Subsequently, the heat output Qh of the refrigeration machine is calculated from the difference of the calculated enthalpies H3 and H1 in accordance with the equation $$Qh=m^{\circ}*(H3-H1) \quad (5).$$

The electrical power Qe1 taken up by the compressor 14 was already determined using the compressor model and is preoperational to the difference of the enthalpies H3 and H2 in accordance with equation (4).

To determine the coefficient of performance COP or the efficiency of the refrigeration machine, subsequently only the quotient of the heat output Qh and of the electrical power Qe1 still has to be formed:

$$COP=Qh/Qe1=(H3-H1)/(H3-H2) \quad (6).$$

In addition, the annual performance index of the refrigeration machine can be determined by an integration of the coefficient of performance over time. Accordingly, the heat output Qh and the electrical power Qe1 can be integrated over time to indicate the heating energy and the taken up electrical energy. The power take-up of additional devices such as pumps, electronics, etc. can in this respect be taken into the calculation through suitable parameters.

Figure 3:
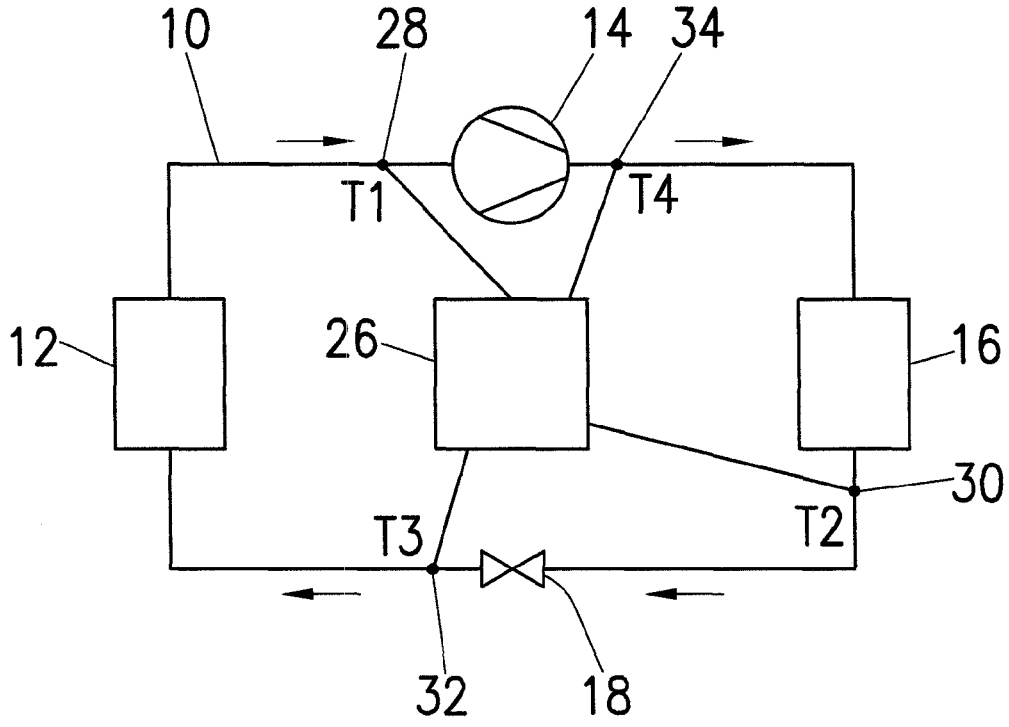
FIG. 3 a schematic representation of a second embodiment of a refrigeration machine in accordance with the invention.

A second embodiment of a refrigeration machine in accordance with the invention is shown in FIG. 3 which differs from the embodiment described above in that a fourth temperature sensor 34 connected to the evaluation unit 26 is arranged in the region of the compressor 14 to determine the refrigerant temperature T4 at the compressor outlet. In this embodiment, the refrigerant temperature T4 at the compressor outlet therefore does not need to be estimated using a compressor model, but is rather measured directly.

In accordance with the first embodiment, while using the pressure equation of the refrigerant used, the evaluation unit 26 calculates the pressure P2 from the received value for the temperature T2 at the outlet of the condenser 16 and the pressure P1 from the temperature T3 at the outlet of the expansion valve 18. Subsequently, in accordance with equations (1) to (3), the enthalpies H1, H2 and H3 are determined from the measured temperatures T1, T2, T4 and from the calculated pressures P1, P2 and the coefficient of performance is determined from these in accordance with equation (6).

Figure 4:
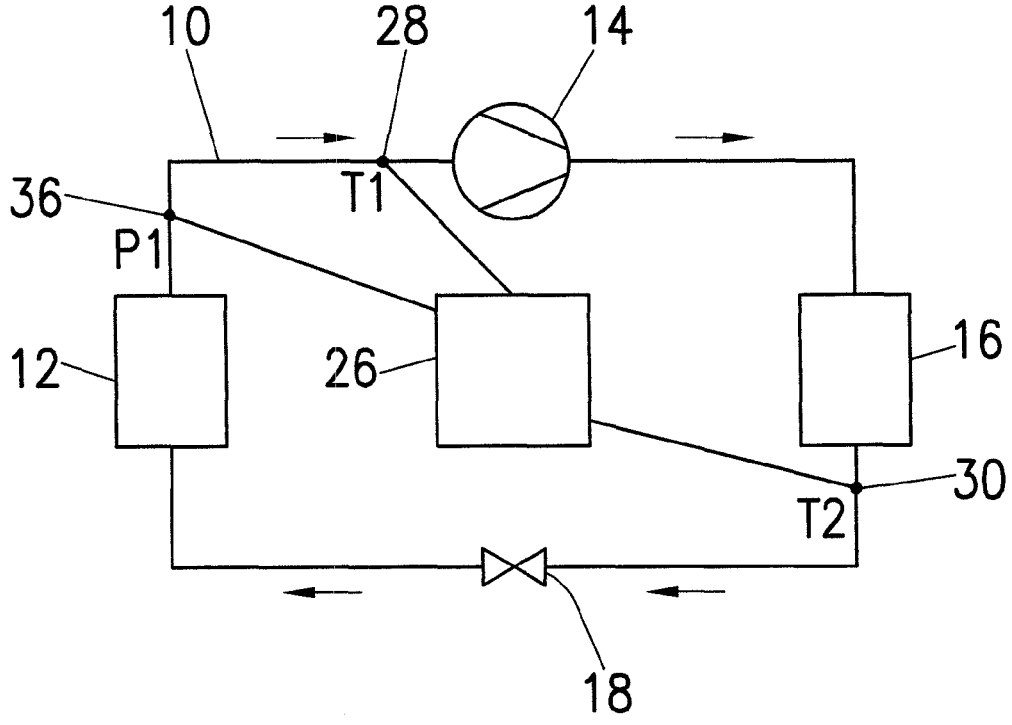
FIG. 4 a schematic representation of a third embodiment of a refrigeration machine in accordance with the invention.

A third embodiment of a refrigeration machine in accordance with the invention is shown in FIG. 4 which differs from the first embodiment described with reference to FIG. 1 in that, instead of the third temperature sensor 32, a pressure sensor 36 is arranged in the region of the outlet of the evaporator 12 to measure the pressure P1 of the refrigerant there. The pressure sensor 36 is connected to the evaluation unit 26 to communicate the measured refrigerant pressure P1 to it.

In this embodiment, the pressure P1 therefore does not need to be calculated from the refrigerant temperature T3 at the outlet of the expansion valve 18, but is rather measured directly. Only the pressure P2 has to be calculated using the pressure equation of the refrigerant used from the temperature T2 at the outlet of the condenser 16 and the refrigerant temperature T4 at the compressor outlet has to be calculated, as explained with reference to FIG. 1, using a compressor model so that the enthalpies H1, H2 and H3 can be determined in accordance with equations (1) to (3) and, in accordance with equation (6), the coefficient of performance of the refrigeration machine can be determined from them.

Figure 5:
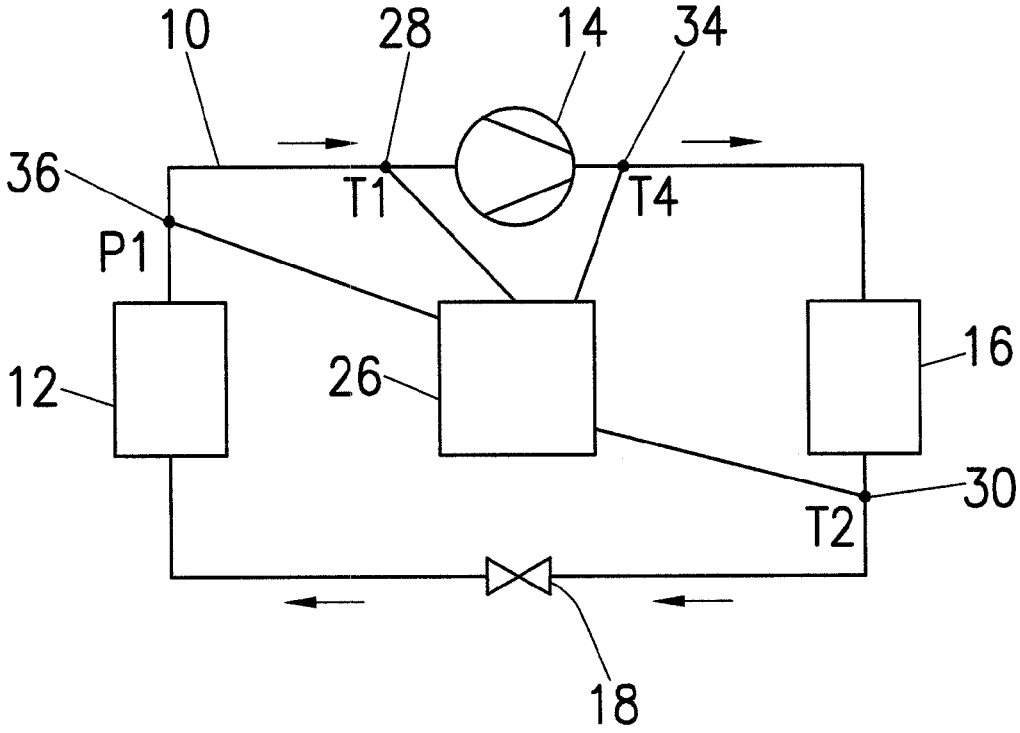
FIG. 5 a schematic representation of a fourth embodiment of a refrigeration machine in accordance with the invention.

A fourth embodiment of a refrigeration machine in accordance with the invention is shown in FIG. 5 which differs from the third embodiment shown in FIG. 4 in that a fourth temperature sensor 34 connected to the evaluation unit 26 is arranged in the region of the outlet of the compressor 14 to determine the refrigerant temperature T4 at the compressor outlet. Unlike in the third embodiment, the refrigerant temperature T4 at the compressor outlet therefore does not have to be calculated using a compressor model in this embodiment, but is rather measured directly in a similar manner to the second embodiment shown in FIG. 2. As in the embodiments described above, the pressure P2 is also calculated from the refrigerant temperature T2 at the outlet of the condenser 16 here.

Subsequently, the enthalpies H1, H2 and H3 are calculated in accordance with equations (1) to (3) from the measured temperatures T1, T2, T4 and the measured pressure P1 as well as the calculated pressure P2, and the coefficient of performance is determined therefrom in accordance with equation (6).

Figure 6:
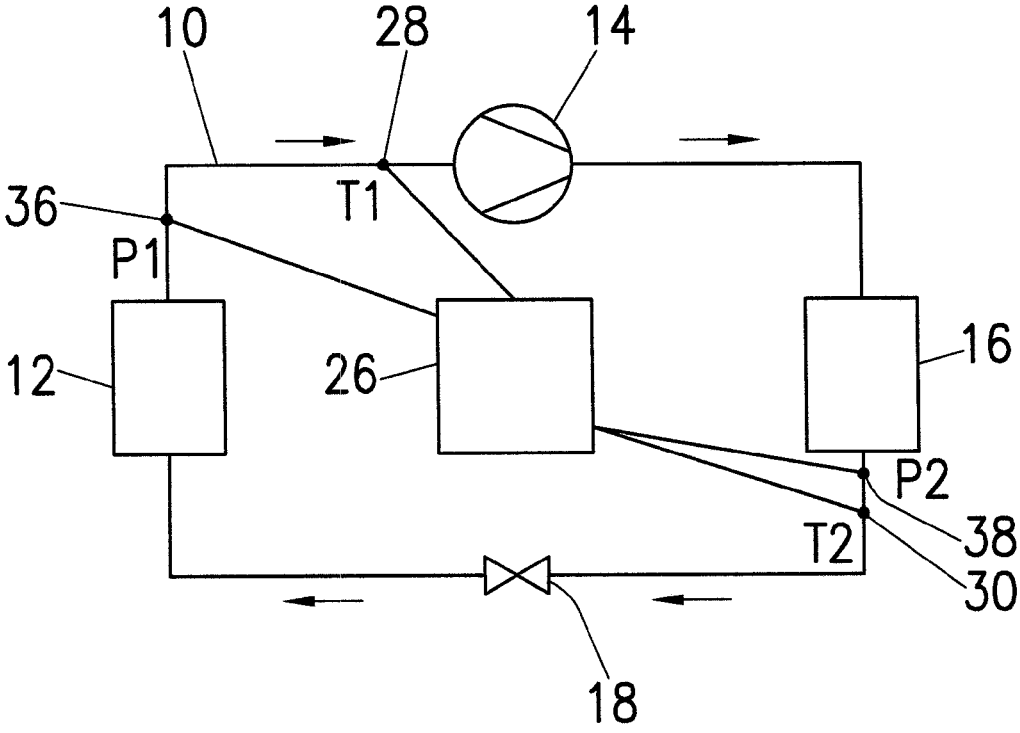
FIG. 6 a schematic representation of a fifth embodiment of a refrigeration machine in accordance with the invention.

A fifth embodiment of a refrigeration machine in accordance with the invention is shown in FIG. 6 which differs from the third embodiment shown in FIG. 4 in that a second pressure sensor 38 connected to the evaluation unit 26 is arranged in the region of the outlet of the condenser 16 to determine the refrigerant pressure P2 at the condenser outlet.

Unlike in the third embodiment, the pressure P2 therefore does not have to be calculated using the pressure equation of the refrigerant used from the temperature T2 at the outlet of the condenser 16 in this embodiment, but it is rather measured directly. Only the refrigerant temperature T4 at the compressor outlet is calculated using a compressor model in this embodiment as described with reference to FIG. 1.

Subsequently, in accordance with equations (1) to (3), the enthalpies H1, H2 and H3 are calculated from the measured temperatures T1, T2 and the measured pressures P1, P2 and from the calculated temperature T4 and the coefficient of performance is determined therefrom in accordance with equation (6).

Figure 7:
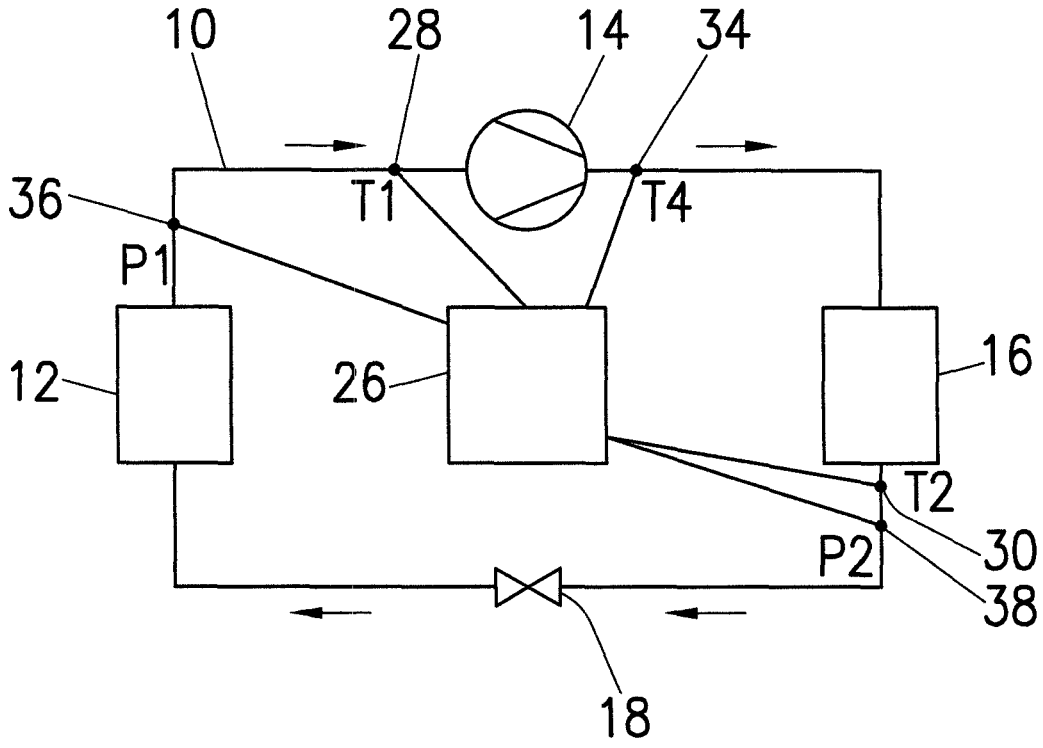
FIG. 7 a schematic representation of a sixth embodiment of a refrigeration machine in accordance with the invention.

A sixth embodiment of a refrigeration machine in accordance with the invention is shown in FIG. 7 which differs from the fifth embodiment shown in FIG. 6 in that a third temperature sensor 34 connected to the evaluation unit 26 is arranged in the region of the outlet of the compressor 14 to determine the refrigerant temperature T4 at the compressor outlet. Unlike in the fifth embodiment, the refrigerant temperature T4 at the compressor outlet therefore does not need to be estimated using a compressor model in this embodiment, but is rather measured directly.

Subsequently, in accordance with equations (1) to (3), the enthalpies H1, H2 and H3 are calculated from the measured temperatures T1, T2 and T4 and the measured pressures P1, P2 and the coefficient of performance is determined therefrom in accordance with equation (6).

We claim:

1. A method for the determination of a coefficient of performance of a refrigeration machine which includes a closed circuit having a refrigerant and in which an evaporator, a compressor, a condenser and an expansion valve are arranged, the method consisting of:

measuring a first temperature in the region of the inlet of the compressor;

measuring a second temperature in the region of the outlet of the condenser;

measuring a third temperature in the region of the outlet of the expansion valve;

calculating a first pressure at the outlet of the evaporator from the third measured temperature using a pressure equation of the refrigerant;

calculating a second pressure at the outlet of the condenser from the second measured temperature using the pressure equation of the refrigerant;

calculating a first enthalpy as a function of the second measured temperature;

calculating a second enthalpy as a function of the first measured temperature and the first calculated pressure;

calculating a third enthalpy as a function of a model of the compressor;

calculating a heat output and a taken up electrical power of the refrigeration machine from differences of the calculated enthalpies; and determining the coefficient of performance of the refrigeration machine from a quotient of the calculated heat output and the calculated taken up electrical power.

2. A method in accordance with claim 1, wherein the refrigeration machine is a heat pump.

3. In a refrigeration machine having a closed circuit including an evaporator having an inlet and an outlet, a compressor having an inlet and an outlet, the inlet of the compressor coupled to the outlet of the evaorator, a condenser havin an inlet and an outlet the inlet of the condenser coupled to the outlet of the compressor, and an expansion valve having an inlet coupled to the outlet of the condenser and an outlet coupled to the inlet of the evaporator, a refrigerant circulating in the closed circuit as saratus for determining a coefficient of preformance of the refrigeration machine, consisting of:

a first temperature sensor positioned to measure temperature of the refrigerant in the region of the inlet of the compressor;

a second temperature sensor positioned to measure temperature of the refrigerant in the region of the outlet of the condenser;

a third temperature sensor positioned to measure temperature of the refrigerant in the region of the outlet of the expansion valve; and an evaluation device coupled to the first, second, and third temperature sensors that determines the coefficient of performance of the refrigeration machine from temeratures of the refrigerant measured by the first, second, and third temperature sensors.

* * * * *